United States Patent [19]

Gibb

[11] Patent Number: 4,756,945

[45] Date of Patent: Jul. 12, 1988

[54] HEAT EXPANDABLE FIREPROOF AND FLAME RETARDANT CONSTRUCTION PRODUCT

[75] Inventor: John F. Gibb, Littleton, Colo.

[73] Assignee: Backer Rod Manufacturing and Supply Company, Denver, Colo.

[21] Appl. No.: 900,185

[22] Filed: Aug. 25, 1986

Related U.S. Application Data

[63] Continuation-in-part of Ser. No. 692,502, Jan. 18, 1985, Pat. No. 4,622,251.

[51] Int. Cl.[4] ..... B32B 3/04; B32B 5/02; F04B 1/74

[52] U.S. Cl. ..... 428/124; 428/126; 428/237; 428/240; 428/365; 428/372; 428/920; 52/404

[58] Field of Search ..... 428/237, 240, 245, 365, 428/372, 376, 920, 921, 124, 126; 52/393, 396, 409, 406

[56] References Cited

U.S. PATENT DOCUMENTS

| | | | |
|---|---|---|---|
| 3,493,460 | 2/1970 | Windecker | 428/240 |
| 3,830,687 | 8/1974 | Re et al. | 428/920 |
| 4,159,302 | 6/1979 | Greve et al. | 428/920 |
| 4,210,070 | 7/1980 | Tatum et al. | 428/920 |
| 4,270,326 | 6/1981 | Hölter et al. | 52/404 |
| 4,516,374 | 5/1985 | Finney | 52/404 |

*Primary Examiner*—John E. Kittle
*Assistant Examiner*—James J. Seidleck
*Attorney, Agent, or Firm*—Klaas & Law

[57] ABSTRACT

A non-combustible blanket material is provided for use in manufacture and construction application to prevent the spread of flames and heat. The blanket material includes a substrate layer made of inorganic fibers formed into a fireproof, porous cloth. In addition, a heat-expandable non-combustible layer is permanently affixed to one side of the substrate layer. This flame retardant layer includes a combination of fireproof manufactured fibrous material of relatively short length and random orientation, heat expandable particles of temperature sensitive material, and a fireproof adhesive for binding the fibrous material and the heat expandable particles together as well as binding the combination to the substrate layer. The heat expandable particles are adapted to increase the thickness of the flame retardant layer when subjected to temperatures substantially in excess of ambient.

28 Claims, 2 Drawing Sheets

HEAT EXPANDABLE FIREPROOF AND FLAME RETARDANT CONSTRUCTION PRODUCT

This application is a continuation-in-part of U.S. patent application Ser. No. 692,502 filed Jan. 8, 1985, now U.S. Pat. No. 4,622,251.

BACKGROUND OF THE INVENTION

1. Field of the Invention

The present invention relates generally to non-combustible construction materials and, more particularly, to a non-combustible blanket material for preventing the spread of fire. Specifically, the present invention relates to a non-combustible heat expandable material in the form of a fire block ranging in consistency from pliable to rigid to be used in various industrial, commercial, transportation and construction applications.

2. Description of the Prior Art

The use of prestressed, precast concrete panels, including curtain wall, in the construction of buildings is well known in the construction arts. Such panels may be used to clad the exterior walls of buildings and may also serve as portions of interior walls. In forming walls from such panels, the panels are purposely spaced apart a predetermined amount to allow for expansion and contraction. The width of the gap or joint between these wall panels is generally on the order of one-fourth inch to one inch.

It has been found that when one surface of a wall formed from such panels is exposed to fire, the capacity of the wall to withstand heat and to prevent the spread of fire to the area on the opposite side of the wall is largely dependant upon the type of material used to fill or seal off the joints between panels.

A problem encountered in joint preparation for resisting the penetration of heat and/or flames has been that during fire conditions an air pressure differential develops between the side of the wall exposed to the fire and the opposite side of the wall. The heat of the fire tends to shrink or burn away and subsequently destroy any sealant material provided at the surface of a joint and the pressure differential between the two sides of the wall tends to cause any other material which is positioned within the joint to be blown out of position or to be distorted or destroyed, allowing the rapid passage of air and thus heat and/or flame from the fire side of the wall to the opposite side of the wall. Once such a flame passage through the joint is provided, fire and smoke spread quickly through the wall to the adjoining area, thus defeating the otherwise excellent fire resistant properties of prestressed, precast concrete and curtain wall panels.

Moreover, in a wide variety of manufactured articles as well as in applications other than joint construction sealing, it would be highly desirable to provide a fire proof mechanism in the form of an effective fire proof covering. For example, the interior walls of airplanes, automobiles and the like are generally very thin and structurally weak. In an event of a fire, the heat and flames can spread very rapidly through the interior walls and into the vehicle compartment. A blanket of fire proof material designed into the wall panel of such vehicles would help inhibit, at least temporarily, the spread of flames and fire thereby providing additional time for passenger evacuation. In other construction applications, such as building walls and ceilings, a wide variety of different sized openings are provided for electrical utilities, plumbing and the like. Fire may readily spread through such openings in the manner described above for wall joints unless an appropriate fire retaining blanket or sheet system is applied thereto.

In order to prevent the spread of fire through joints and other wall or ceiling openings, various joint treatments have been utilized in the past which provide a layer of blanket-like fire resistant material which is supported in position by a polyethylene, closed-cell backup strip positioned adjacent to the fire proof blanket material or alternately positioned near the opposite wall surface of the joint in an attempt to stabilize the fire resistant blanket material within the joint. A problem with such prior art solutions has been that the handling and installation of this blanket material and foam rod combinations is usually relatively slow and labor intensive and thus considerably increases the cost of joint preparation making them very expensive.

Various materials and procedures for forming fire resistant joints are discussed in a publication of the Portland Cement Association entitled "Fire Tests of Joints Between Pre-Cast Concrete Wall Panels: Effects of Various Joint Treatments" by A. H. Gustarerro and M. S. Abrams, *PCI Journal*, September/October 1975, pages 44–64. This report indicates that it is known to treat a joint for fire prevention by placing a neoprene tube filled with ceramic fibers in a portion of the joint slightly recessed from one wall surface and to thereafter seal off the recess space between the neoprene tube and wall face with a joint sealing material such as polyoxide urethane sealant. A problem with the use of a neoprene tube filled with ceramic fibers is that neoprene has limited heat resistance and produces substantial smoke emission when it oxidizes. Another problem is that the placement of ceramic fiber into a tube is extremely slow and expensive and is therefore impractical in lengths of more than a few inches.

The prior art limitations described above relative to prevention of fire propagation through joints are also applicable to the prevention of the spread of fire through other wall and ceiling openings as well as to the delay of fire propagation in the construction of vehicles such as automobiles, airplanes and the like. Thus, there is a need for effective, yet simple, fire proof manufacture and construction materials and systems.

SUMMARY OF THE INVENTION

Accordingly, it is one object of the present invention to provide a fireproof blanket material and other molded shapes of the same material which may be utilized in articles of manufacture as well as in various construction assemblies to block the propagation of fire.

It is another object of the invention to provide a fireproof blanket or sheet material which is low cost in manufacture and readily adaptable to a variety of manufacturing and construction applications.

It is also an object of the present invention to provide a non-combustible construction assembly for closing a wall joint wherein the joint filling remains in position and prevents passage of heat and flame through the joint even after continued exposure to heat and/or flame at one side of a wall formed by concrete or other similar panels.

It is also an object of the present invention to provide a joint treatment as described above wherein the joint treatment requires a relatively small amount of labor.

To achieve the foregoing and other objects and in accordance with the purpose of the present invention, a non-combustible blanket material is provided for use in manufacture and construction application to prevent the spread of flames and heat. The blanket material includes a substrate layer made of inorganic fibers formed into a fireproof, porous cloth. In addition, a heat-expandable fire proof layer is permanently affixed to one side of the substrate layer. This fire proof layer includes a combination of fireproof manufactured fibrous material of relatively short length and random orientation, heat expandable particles of temperature sensitive material, and a fireproof adhesive for binding the fibrous material and heat expandable particles together as well as binding the combination to the substrate layer. The heat expandable particles are adapted to increase the thickness of the fire proof layer when subjected to temperatures substantially in excess of ambient.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in which:

DETAILED DESCRIPTION OF THE PREFERRED EMBODIMENTS

Figure 1:
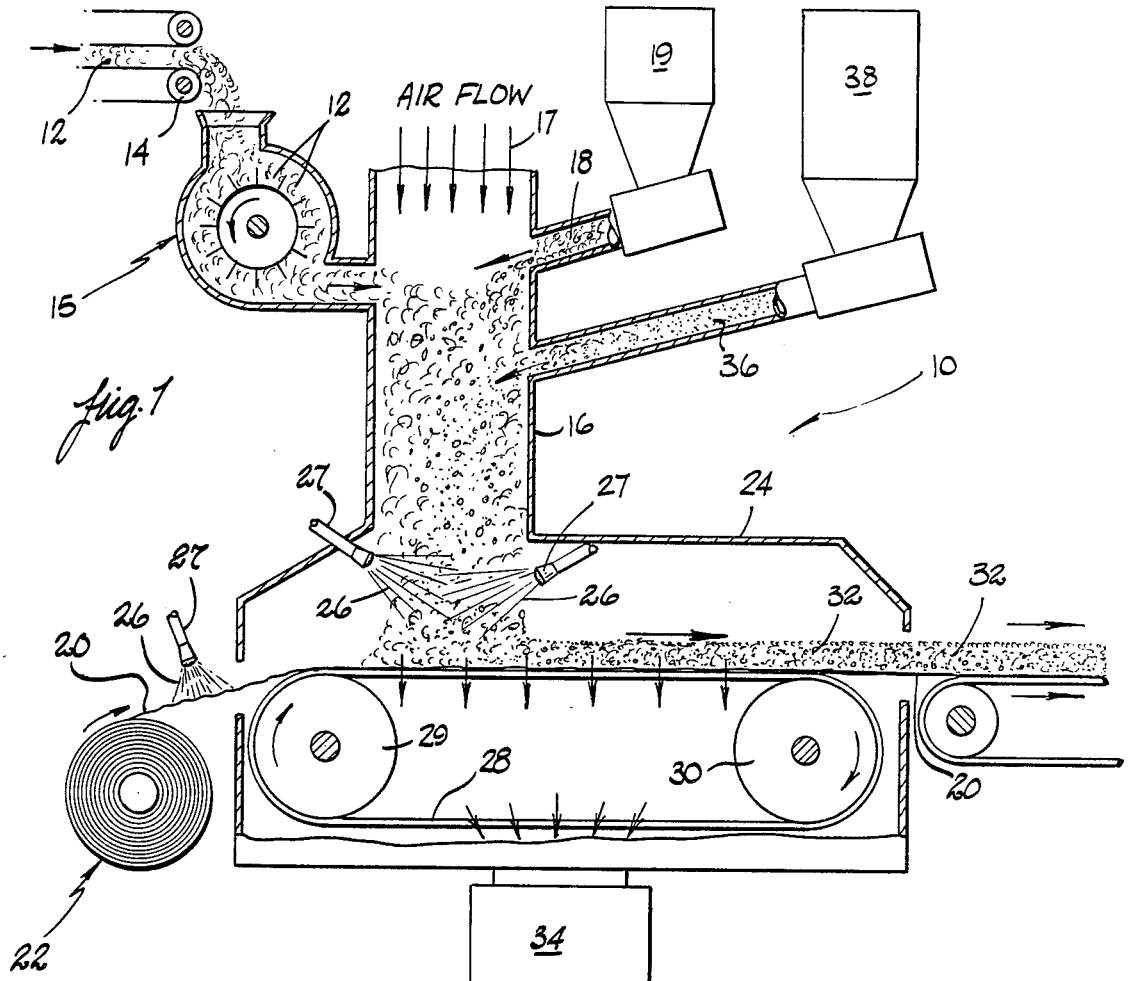
FIG. 1 is a schematic cross-sectional view of a first portion of an apparatus for forming a non-combustible blanket material of the present invention.
Figure 2:
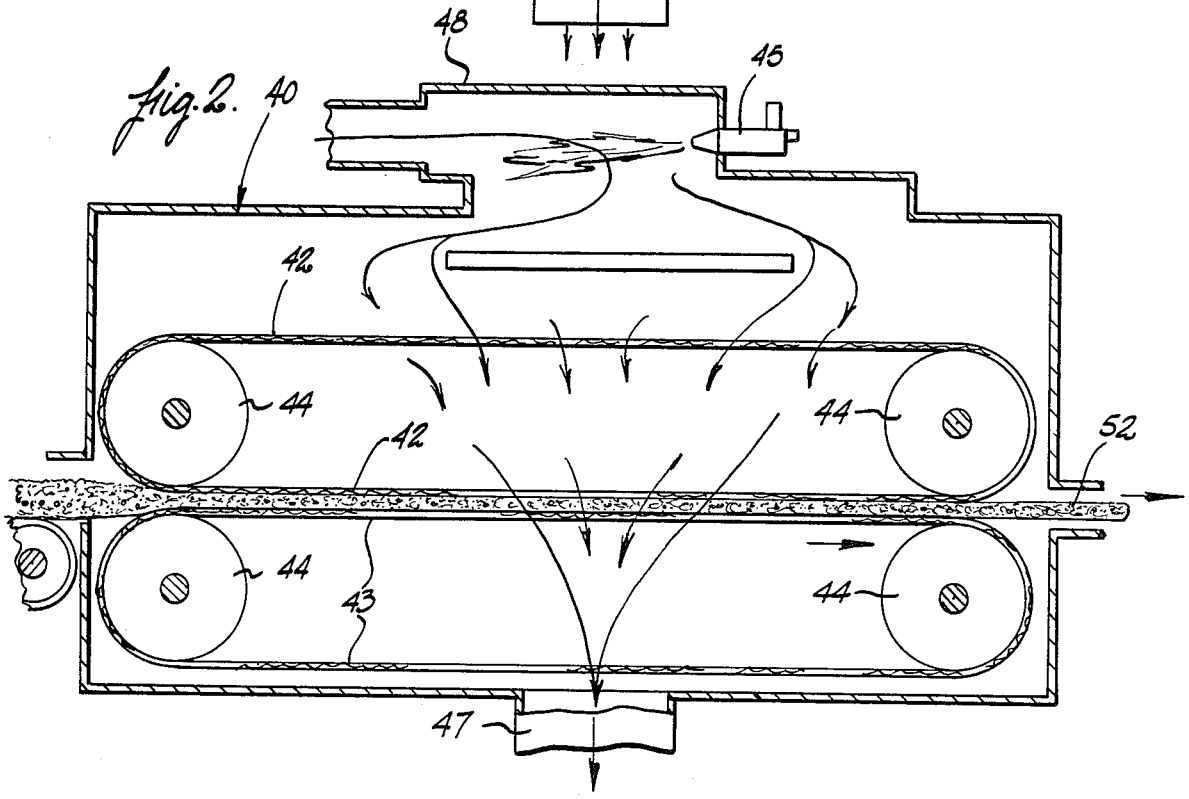
FIG. 2 is a schematic cross-sectional view of the second portion of the blanket in the apparatus of FIG. 1.

A non-combustible blanket and sheet material forming apparatus 10 of the present invention is illustrated in schematic form in FIGS. 1 and 2. In preferred form, compacted fibrous material 12 as described in more detail below is fed by a conventional conveyor (not illustrated) into a pair of picker feed rolls 13 and 14 which deliver the fibrous material 12 at a controlled rate to a conventional picker machine 15. The picker machine 15 fluffs up the compacted fibrous material 12 and forceably directs it into a plenum chamber 16 having an air stream 17 which passes through the chamber 16 to and through a continually moving substrate glass cloth web 20 or similar functional material as described below. The filling or fibrous material 12 of the present invention, in one preferred embodiment, includes a non-combustible porous fiber material such as, for example, ceramic fibers, mineral wool, glass fibers or any combination thereof. This fiber material comprises a number of randomly oriented, relatively short length, e.g., approximately ¼" to 2" and preferably ¼" to 1¼" dimension, fibers having a diameter of generally no less than 3 microns. The fiber material is preferably produced by conventional fiber forming techniques and has the property of being flexible, resiliently compressible and relatively light weight due to its porous composition.

The fiber material 12 is mixed with a number of relatively small particles, e.g. of a size capable of passing through a 0.25 inch screen mesh and preferably approximately 1/16 inch to ¼ inch maximum dimension, of minerals 18 such as unexpanded vermiculite and/or perlite which have the property of expanding in volume when exposed to intense heat. The unexpanded particles 18 are contained in a feed hopper 19 and are fed therefrom into chamber 16. The diametric expansion ratio of vermiculite and perolite when exposed to temperatures substantially above ambient, e.g., 400° F. or above, is on the order of ten to one. The combination of fibrous material and heat expandable particles includes approximately 25–50% by weight of heat expandable particles.

Figure 7:
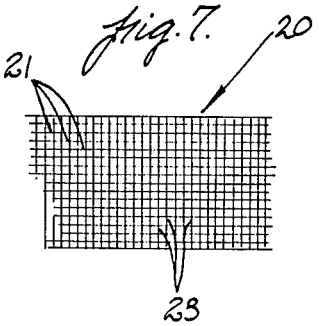
FIG. 7 is a plan view of a portion of a substrate web used in forming the fireproof blanket material of the present invention.

A porous backing material 20 may be constructed from a number of non-combustible, open-weave materials such as fiber glass or the like. As illustrated by FIG. 7, in one embodiment of the invention the backing material has an open rectangular cloth weave formed by a plurality of longitudinally extending fiber glass strands 21 weavingly intermeshed with a plurality of transversely extending strands 23. Backing material of this composition is preferably pliant and may be formed by conventional fiber glass weaving techniques which are well known in the art. The fiber glass strands may have a thickness of between 0.004 inches and 0.01 inches and the amount of porosity, i.e., open space in the weave, may be between 20% and 85%. The fiberglass strands range in size from approximately 8 to 16 ounces per square yard and are arranged in a relatively loose weave to provide the desired porosity. Other manners of forming the substrate may also be utilized so long as the desired porosity is achieved.

Referring again to FIGS. 1 and 2, it may be seen that a continuous web of backing material 20 is provided from a conventional unwind roll 22 which may be a driven roll or alternatively an idler roll adapted to unwind purely through the drawing tension placed on the web by an upstream drawing device (not illustrated). A portion of the web of backing or substrate material 20 passes directly below a discharge end of the forming chamber 24 at the lower end of the plenum chamber 16 in which the fibrous materials 12, mineral particles 18 and adhesive binders 26 (see below) are joined together. As these solid materials 12 and 18 pass down through the plenum chamber 16 into the forming chamber 24, they are sprayed with the adhesive binder 26 using nozzles 27 to the proper degree. This matrix is then carried downward in the air flow and deposited onto the glass cloth or other suitable material 20 which is moving across a continuous screen conveyor 28, which conveyor is driven by a pair of rollers 29 and 30. The air flow passes through the glass cloth substrate 20 and screen conveyor 28 leaving behind the matrix 32 of fibrous material 12, mineral particles 18 and adhesive binder 26 having a density of approximately 3 to 4 pounds per cubic foot. The air flow 17 downward through the glass cloth substrate 20 is preferably at a velocity of about 2 feet per second to as high as 5 feet per second.

As shown in FIG. 1, the air flow pattern is preferably developed by a high velocity, high pressure exhaust fan 34 located below the forming chamber 24. The expandable mineral materials 18 are introduced into the circuit at the upper end of the plenum chamber 16. When a mineral type binder, such as a mineral cement 36 that will hydrate, is used in order to form a non-flexible final product (as described below), it too is added at the same time and general position as the expandable mineral 18 to allow enough time to mix completely with the fibrous material 12 as it travels the full length of the plenum chamber 16 to the substrate below upon which it is deposited. Such a cement 36 is preferably contained in and fed from a separate hopper 38. The substrate glass cloth is also preferably sprayed as illustrated before it enters the forming chamber.

The amount of fibrous material 12 and mineral additives 18 deposited on the underlying substrate 20 will be determined by the amount of these various materials introduced into the system as well as with the speed of the moving porous substrate (glass cloth) 20 on the screen conveyor 28 upon which it rides. The amount of compaction of the matrix 32 deposited onto the screen will be dependent on the wetness of the final deposited matrix 32 and the setting of the exhaust fan rate of air flow and pressure.

The adhesive application nozzles 27 are positioned to permit the spraying of adhesive 26 as described below into the mixture of materials 12 and 18 from at least one and preferably from a multiplicity of directions, as shown in FIG. 1, so as to intimately intermix the adhesive 26 being injected into the stream with the filling material mixture. In this manner, the materials 12 and 18 are adhered together as they are deposited onto the web 20 as well as adhered to the web 20. To assist in adherence to the web 20, the web 20 is first preferably presprayed with adhesive 26 before it enters the chamber 24 as illustrated in FIG. 1.

In preferred form, a lagging adhesive of any desired type may be utilized. A fire rated, water based lagging adhesive is preferably utilized and is diluted to approximately 25% from commercially available formulations so as to provide the desired consistency. The lagging adhesive is preferably a fire rated, water based rubber type treated in a manner so that its burning rate is extremely slow to non-existent. A typical commercially available lagging adhesive is Benjamin Foster 81–42 W. In one preferred embodiment, the lagging adhesive has a consistency of latex paint so as to provide resiliency and pliancy in to the end product.

In another embodiment as further described below, the adhesive may preferably be a fireproof plaster paris type material or cement 36 so that once the adhesive has solidified, the resultant blanket and sheet material is semi-rigid to rigid in form rather than resilient, the adhesive also functioning as a stiffening agent. This type of adhesive binder would be a material such as a mineral material that will hydrate, that is take on water to solidify. Examples of such material 36 would be plaster of paris or portland cement. These materials not only bind the fibrous and expandable minerals 12 and 18 together but also bind them to the substrate 20 as well. In this instance, water is sprayed from nozzles 27 to hydrate the cement. In all cases, no matter what type adhesive binder used in the present invention, it would be applied in such a manner in velocity and amounts to ensure intimate contact and admixture with all fibrous and expandable mineral materials 12 and 18 along with the substrate materials 20.

Downstream from the forming chamber 24, the fibrous matrix 32 adhered to the substrate 20 passes into a drying chamber 40 as illustrated in FIG. 2. This drying chamber 40 preferably includes two conveyors 42 and 43 driven by rollers 44 and of such a perforated construction as to allow the passage of hot air from an air heater 45 down through the conveyors 42 and 43. The substrate 20 with matrix 32 passes into chamber 40 through an opening 46 and is passed between the conveyors 42 and 43. Thus, the hot air passes through the fibrous matrix 32 and substrate 20 drying out the adhesive binder and then passes out of the drying chamber 40 through an air exit 47. This exhaust air is then recycled back through the air heater 48, and the cycle in then repeated. Approximately 10% of the circulated air is exhausted on each cycle to reduce the water content in the circulating air. The two conveyors 42 and 43 in the drying chamber 40 oppose each other in position so that the bottom conveyor 43 carries the matrix 32 and substrate 20 through the drying chamber 40, and the top adjustable conveyor 42 compacts the matrix 32 down onto the substrate 20 to the desired thickness to form the final sheet or blanket material 52. The top conveyor 42 is adjustable up and down to permit a range of thicknesses and densities for the material 52 within the movement capabilities of the conveyor 42.

Once the completed blanket and sheet material 52 has been formed, it is then preferably cut into appropriate sizes depending upon the desired end use. In any of various possible applications of the invention, the end use frequently requires that the blanket and sheet material 52 be resilient and pliant, such as in covering automobile seats, airplane seats, insertions within wall joints, covering openings in walls and ceilings, and the like. In other instances, it is desired to form the blanket material 52 into more rigid sheets to be placed against an entire wall surface of a building structure to increase the fire resistance thereof. In each of these instances, the material is cut into the desired width and length.

Figure 4:
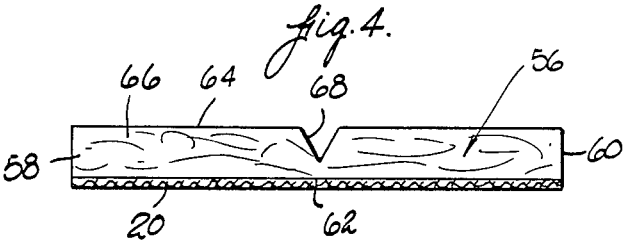
FIG. 4 is an enlarged schematic view of the joint filling material formed in FIG. 3.
Figure 5:
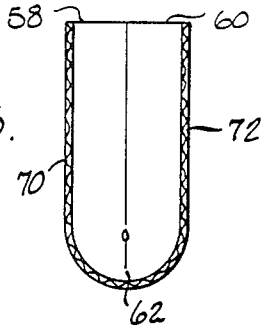
FIG. 5 is a schematic view of the blanket material after folding into a U-shaped embodiment for use as a joint filler.
Figure 3:
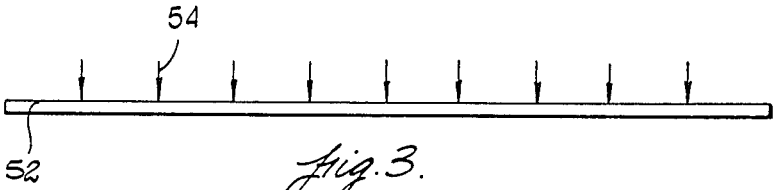
FIG. 3 is a schematic of the blanket material formed from the apparatus of FIG. 1 and illustrating one embodiment thereof for use as a joint filling material.

In one specific application of the invention, it is desired to cut the sheet of blanket material 52 into a plurality of narrow segments as illustrated in FIG. 3. Thus, the sheet 52 is cut at points 54 to form individual strips 56 as illustrated in FIG. 4. In forming fireproof joint filler material, it is preferred that the individual strips 56 having side portions 58, 60 and a longitudinal axis at point 62 be grooved along the surface 64 of the non-combustible layer 66. The groove 68 is formed along the longitudinal axis 62 to permit easy folding of the strip 56 as more clearly illustrated in FIG. 5. Since the groove 68 is disposed along the centerline of the strip 56, the end portions 58, 60 align and abut with each other when the strip 56 is folded as illustrated in FIG. 5. In this manner, the outer oppositely disposed surfaces 70, 72 consist of the fiber glass webbing or backing layer 20, while the inner portions of the joint filler strip 56, when folded, consist entirely of the non-combustible layer 66 having heat expandable particles 17 therein.

Figure 8:
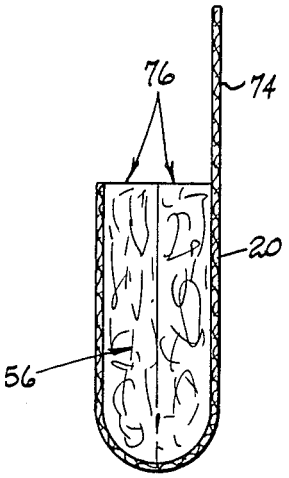
FIG. 8 is an alternate embodiment of the invention illustrated in FIG. 5.
Figure 9:
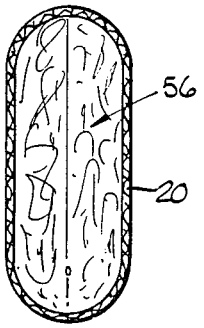
FIG. 9 is another view of the embodiment of FIG. 8 in a fully folded position.

A slight variation of the embodiment described above, is illustrated in FIGS. 8 and 9. In this alternate embodiment, a portion of the web or backing material 20 may be left uncovered with flame retardant material as shown at side portion 74. This extended portion 74 may be then folded over as illustrated in FIG. 9 to overlap the exposed ends 76 of the end portions 58, 60.

In this manner, the entire outer surface of the folded joint filler strip 56 is covered by the backing or web material 20 to ensure complete compression once the folded strip 56 is inserted within a wall joint as described below.

Figure 6:
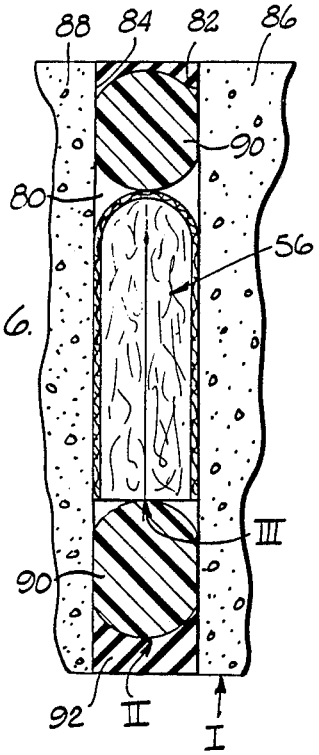
FIG. 6 is cross-sectional view illustrating one embodiment of a joint filler blanket of the present invention placed into the wall joint between adjacent building construction panels.

Referring now to FIG. 6, once the barrier strip 56 has been formed in the described folded position, is readily inserted within the joint 80 between two end portions 82, 84 of concrete wall members 86, 88, respectively. The strip 56 is sized and shaped so that it is placed into compression when inserted within the joint 80. However, it should be noted that the strip 56 should not be so oversized so as to make it difficult to insert within the joint 80, for heat will cause the vermiculite or perlite particles within the strip 56 to expand and thereby increase the compression thereof as described below. Once this fireproof blanket strip 56 is placed within the joint 80, open cell urethane backer rods 90 may be placed in either side of the joint 80. The urethane backer rods may be of standard construction or may be constructed in accordance with the invention described in the previously referenced U.S. patent application Ser. No. 692,502, the contents of which are specifically incorporated herein by reference.

More specifically, a folded strip 56 is inserted into the joint 80 and initially or subsequentially cut to a length approximately equal to or slightly longer than the length of the joint. The strip 56 which is used for any particular joint is chosen to have an overall folded thickness substantially larger, e.g., 20–50% larger, than the width of the joint being filled and is thus compressed, e.g., from 3 or 4 pounds per cubic foot to a density of 8 pounds per cubic foot, as it is inserted into the joint. The strip 56 is preferably pressed into the center portion of the joint 80, after which the backer rods 90 may then be inserted at either side of the joint 80. Elastomeric sealing material 92, of any type well known in the art, may be placed at the very outer portion of the joints 80 to cover the backer rods 90. The sealing material 92 initially provides an air tight and waterproof seal and an aesthetically pleasant appearance to the surface of the joint. It should be noted, however, that the arrangement of the present invention may also be used without a sealer material as well as without the backer rods 90 and will allow limited air flow through the joint duct due to the porous construction of the filler and backing material.

If one surface of a wall formed by the construction panels 86, 88 is exposed to heat and/or flame of sufficient intensity, e.g., a temperature of 400° F. and above, the concrete panels 86, 88 expand causing compression of the joint 80 which in turn causes rupturing of the sealant 92. Continued exposure to intense heat may cause the sealant material 92 to shrink, fall or burn out of the joint 80. However, the filler strip 56 being formed from non-combustible filler material 16, backing material 20 and adhesive 41 does not burn, shrink or separate and, due to the expansion of the panels 86, 88 and the subsequent shrinking of the joint 80, the strip 56 is urged into even firmer compressive contact with the adjacent walls 82, 84 of the joint 80. This effect may be significantly enhanced by use of a filler material of the composition described above having the heat expandable particles 18 therein. The relative amount of expansion of the strip 56, may, of course, be predetermined by the ratio of mineral material 18 to non-combustible fiber material 17 that is used. When the strip 56 is placed into position in a joint 80, the size of the joint and the density of the fiber material in the strip 56 are preferably such that the pressure applied by the building panels further compacts the fiber particle mixture to a density in excess of 4 pounds per cubic foot with the fiber material being sufficiently resilient to exert a retaining force against the panels of at least 0.05 pounds per square inch.

Tests utilizing the blanket material of the present invention as configured in FIG. 5 and as inserted within a joint as illustrated in FIG. 6, were conducted. These tests were conducted with joints having thicknesses of ½ inch, ¾ inch and 1 inch. The blanket material of the present invention was formed having an ½ inch non-combustible layer 16 thereon. In the tests conducted, the strip 56 was formed in a U-shape manner as illustrated in FIG. 5 and then inserted into a joint as illustrated in FIG. 6. A gas flame of approximately 1,800° to 2,000° F. was then applied directly to the joint on one side of the panels 86, 88. Temperatures were then measured on the opposite side of the joint at three different positions: Position I being on the wall surface adjacent to the joint, Position II being behind the backer rod 90, and Position III being immediately behind the folded blanket strip 56 (see FIG. 6). Temperatures were then measured at each of the Positions I–III after one hour and again after two hours of continuous intense heating. The temperature test results are provided in Table I below.

| | Test Location | I | II | III |
|---|---|---|---|---|
| ½" joint - 56° F. | 1 hr. | 203° | 200° | 255° |
| Ambient Temp. | 2 hrs. | 300° | 302° | 368° |
| ¾" joint - 62° F. | 1 hr. | 236° | 227° | 326° |
| Ambient Temp. | 2 hrs. | 299° | 289° | 403° |
| 1" joint - 77° F. | 1 hr. | 213° | 177° | 337° |
| Ambient Temp. | 2 hrs. | 299° | 257° | 457° |

All of the temperature measurements provided above are within the published two-hour fire rating ASTM Test Standards E 814 and E 119.

As previously mentioned, the present invention has a wide variety of applications. It may be used in a folded, U-shaped configuration described in detail above as a joint filler material to prevent fire propagation between wall joints. It may be also utilized to cover apertures in walls for electrical conduit, pipes and the like as well as to fill voids in walls and ceilings. Moreover, in such applications, the blanket material of the present invention meets the hose stream test of 30 lbs. due to its flexible configuration as described above. In an alternate configuration wherein inorganic hydrating cement is utilized as the adhesive material, the blanket and sheet material of the present invention may also be used as a wall board type of material in building construction.

Moreover, as previously mentioned, the flexible and pliant version of the blanket material of the present invention may be adapted for covering or lining chairs and seats in vehicles such as airplanes and automobiles so as to assist in preventing propagation of fire therein in the event of an accident. While such applications would not totally inhibit propagation and spreading of fire, such applications would diminish the speed of fire propagation thereby increasing the opportunity and time available for passenger evacuation of the vehicles in the event of fire. For the same reason, the present invention may be applied in blanket form within the wall construction of airplanes, automobiles and such vehicles to likewise reduce fire propagation and provide additional time for evacuation, thereby increasing the safety of such vehicles in the event of an accident. In conjunction with the above uses, the present invention is also economical and easy to manufacture and is likewise relatively easy to mold and shape to utilize in the various aforementioned applications.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein, but may be modified within the scope of the appended claims.

What is claimed is:

1. A non-combustible blanket material for use as a barrier to prevent the spread of products of combustion between fixed spaced surfaces, said blanket material comprising:

a continuous length of a substrate layer means made of non-combustible inorganic fibers formed into a non-combustible, porous flexible cloth-like material;

a continuous length of heat-expandable, non-combustible laterally expandable layer means permanently affixed to one side of said substrate layer means and comprising a homogeneous uniformly dispersed combination of non-combustible manufactured fibrous material of relatively short length and random orientation, and unexpanded non-combustible heat expandable particles of temperature sensitive material, and a non-combustible adhesive binder for binding said manufactured fibrous material and heat expandable particles together as well as binding said combination to said substrate layer means, said substrate layer means and said non-combustible layer means being flexible and resilient and compressible and providing a pliant, resilient continuous length of blanket material for compressible insertion in abutting engagement with and retention between the fixed spaced support surfaces; and said heat expandable particles being expandable after insertion between the fixed spaced support surfaces to expand said non-combustible layer means when subjected to combustion temperatures substantially in excess of ambient temperature for retaining the blanket material between the fixed spaced surfaces and preventing passage of products of combustion there-through during a fire.

2. The blanket material as claimed in claim 1, wherein said substrate layer means comprises fiberglass strands woven together to form said porous cloth-like material; and wherein said fiberglass strands range in size from 8 to 16 ounces per square yard and arranged in a relatively loose weave to provide said porosity.

3. The blanket material as claimed in claim 1, wherein said heat expandable particles are selected from the group consisting of unexpanded vermiculite and unexpanded perlite.

4. The blanket material as claimed in claim 1 or 3, wherein said manufactured fibrous material is selected from the group consisting of mineral wool, glass fibers and ceramic fibers.

5. The blanket material as claimed in claim 4, wherein said manufactured fibrous material range in size from 0.25–2.0 inches in length and have a diameter of generally no less than approximately 3 microns.

6. The blanket material as claimed in claim 4, wherein said combination of fibrous material and heat expandable particles includes approximately 25–50% by weight of said heat expandable particles.

7. The blanket material as claimed in claim 4, wherein said heat expandable particles are of a size capable of passing through a 0.25 inch screen mesh.

8. The blanket material as claimed in claim 4, wherein said adhesrive binder comprises a fire rated, water based lagging adhesive.

9. The blanket material as claimed in claim 1 or 4, wherein said blanket material is constructed in the form of a laminate sheet having an elongated rectangular shape with a pair of elongated side edge portions extending substantially parallel to a central longitudinal axis; and said blanket material further includes an elongated groove disposed in a surface of said non-combustible layer means extending along said central longitudinal axis for enabling said laminate sheet to be folded along said central longitudinal axis with the side edge portions thereof being located in juxtaposition with one another to form a joint filling strip means having a U-shaped configuration with said non-combustible layer means located in inwardly oppositely facing abutting relationship and said substrate layer means located in oppositely outwardly facing, laterally spaced relationship.

10. The blanket material as claimed in claim 9, wherein said joint filling strip means is disposed in a joint space defined by oppositely facing spaced side wall surfaces of a wall of a building with the outer substantially parallel spaced surfaces of the substrate layer means being in abutting supporting engagement with said side wall surfaces; and said non-combustible layer means extending laterally across said joint with said parallel portions being supported in abutting, resiliently compressed relationship to provide air tight sealing means between said side wall portions and to enable lateral expansion upon application of fire generated heat to said heat expanding particles.

11. A non-combustible construction assembly for closing a joint between spaced side surfaces of adjacent building construction components made of a non-combustible material, said assembly comprising:

two adjacent building construction components made of a non-combustible material and having an elongated joint between spaced side surfaces thereof;

a folded blanket of non-combustible material mounted in a folded condition in said joint and having a length of approximately as long as the length of said joint and extending across the width of said joint and having side surface portions located in abutting engagement with said spaced side surfaces;

said blanket comprising:

a base layer of non-combustible porous material;

a relatively thick, heat expandable non-combustible layer permanently affixed to one side of said base layer and comprising a mixture of relatively short length, randomly oriented separate fibers and of heat expandable particles of temperature sensitive material; and said blanket being manufactured in the form of an unfolded sheet of blanket material having an elongated rectangular shape with a pair of elongated side edge portions and a pair of elongated side surface portions extending parallel to a central longitudinal axis, said heat expandable non-combustible layer having an elongated groove disposed along said central longitudinal axis to enable said blanket to be folded along said central longitudinal axis with said side edge portions being located in juxtaposition to one another to fold said blanket into a substantially U-shaped configuration with said heat expandable non-combustible layer having two portions on opposite sides of said groove located in inwardly oppositely facing abutting relationship and said base layer having two portions on opposite sides of said groove being located in oppositely outwardly facing laterally spaced relationship for disposition against the side surfaces of said adjacent building components within said joint; and said unfolded sheet of blanket material having a thickness greater than one-half the width of said joint thereby enabling said folded blanket to be compressed and retained in said joint by pressure applied by the spaced side surfaces of said adjacent building construction components when said blanket is in the folded position within said joint.

12. The construction assembly as claimed in claim 11, wherein said randomly oriented separate fibers and said heat expandable particles are compacted by pressure applied by the spaced side surfaces of said adjacent building construction components against said base layer to a density of at least 4 pounds per cubic foot and are sufficiently resilient to assert a retaining force on the side surfaces thereof of at least 0.05 pounds per square inch.

13. The construction assembly as claimed in claims 11 or 12, wherein said base layer is constructed from flexible porous material and said heat expandable non-combustible layer is constructed from a resilient mass of adhesive binder, fibers and particles.

14. A length of unitary joint packing material for providing a sealable non-combustible flame barrier in a joint between opposite spaced side surfaces of construction components which comprises:

a continuous, homogeneous compressible, flexible, resilient, elongated, heat expandable portion comprising a mixture of randomly oriented, separate, individual, relatively small diameter, relatively short-length, non-combustible, manufactured fibers selected from the group consisting of mineral wool, glass fibers and ceramic fibers, and non-combustible heat expandable particles adhered together by an adhesive binder;

substrate support means associated with and supporting said heat expandable portion of the packing material and maintaining the integrity of said heat expandable portion of the packing material during manufacture, transportation and placement in the joint and while in position in the joint;

said substrate support means comprises a thin, porous, non-combustible, cloth-like material having one side thereof secured to said heat expandable portion of the packing material and having a porosity such as to prevent passage of said fibrous material and said heat expandable particles therethrough while permitting substantially unrestricted passage of air therethrough during manufacture of the packing material; and said heat expandable portion of the packing material being thicker than said cloth-like material and having a central, elongated, resilient portion therein to permit folding of the packing material into a substantially U-shape position, the cross-sectional size of the folded packing material being larger than the width of the joint whereby the folded packing material is resiliently, compressibly insertable and retainable in the joint and whereby the packing material is retained between the opposite spaced side surfaces of the construction components by resilient compressive forces and forms a fire tight seal and a flame blocking barrier therebetween by expansion of said heat expandable particles when subject to high temperatures during a fire.

15. The joint packing material as defined in claim 14 and wherein:

said heat expandable particles are selected from the group consisting of unexpanded vermiculite and unexpanded perlite.

16. The joint packing material as defined in claim 14 or 15, and wherein:

said non-combustible, fibrous material and said heat-expandable particles are held in closely spaced, compacted relationship by said substrate support means and said adhesive binder and have a density of at least 3 pounds per cubic foot in a normal pre-assembly condition and have the capability of being further compacted to a density of at least 8 pounds per cubic foot by compressive forces applied through said packing material in the folded condition in the joint between the spaced side surfaces of the construction components.

17. The joint packing material as claimed in claim 14 or 15 and wherein:

said substrate support means comprises a continuous length of flexible, resilient, cloth-like material made of non-combustible inorganic material having a porosity of between approximately 20% and 85% per unit area.

18. Apparatus for preventing passage of products of combustion through an elongated passage between laterally spaced side surfaces of adjoining construction members and comprising:

a continuous one-piece length of flexible, resilient, compressible, porous, blanket-type material of rectangular cross-sectional configuration having a length and width substantially greater than the thickness thereof;

said blanket-type material comprising:

a thin, cloth-like substrate layer of porous non-combustible inorganic material;

a heat expandable non-combustible layer affixed to said substrate layer and being thicker than said substrate layer and comprising a mixture of relatively short length randomly oriented non-combustible fibers and unexpanded heat expandable particles of temperature sensitive material; and non-combustible bonding means for binding said non-combustible fibers material and said heat expandable particles to one another and to one side surface of said substrate layer to provide a continuous self-supporting strip of the blanket-type material having a size and shape for enabling mounting and retention in the elongated passage in continuous abutting engagement with the laterally spaced side surfaces of the adjoining construction members whereby upon application of heat from a fire, said heat expandable particles are expanded to retain and prevent removal of the blanket-type material from the elongated passage and to prevent passage of products of combustion through the blanket-type material and the passage.

19. The invention as defined in claim 30 and wherein:

the heat-expandable particles are selected from the class comprising vermiculite and perlite.

20. The invention as defined in claims 18 or 19 and wherein:

said non-combustible fibers being selected from the group consisting of mineral wool, glass fibers and ceramic fibers and non-combustible, heat-expandable particles.

21. The invention as defined in claim 20 and wherein:

the thickness of the unfolded blanket-type material is less than the width of the passage and of sufficient thickness for enablikng the blanket material to be folded and inserted in a folded condition and when folded have a folded thickness greater than the width of the passage so as to be compressibly retainably mounted between the side surfac®s of the adjoining construction members.

22. The invention as defined in claim 21 and further comprising:

fold means provided on the blanket material for enabling the blanket material to be folded into a U-shape cross-sectional configuration when mounted in the passage between the side surfaces of the adjoining construction members.

23. The invention as defined in claim 20 and wherein:

the length of said non-combustible fibers is between approximately ¼ inch to 2 inches; and the size of said heat-expandable particles is between approximately 1/16 to ¼ inch.

24. The invention as defined in claim 23 and wherein:

the ratio of expansion of said heat-expandable particles is at least approximately 10 to 1 at about 400° F. or more.

25. The invention as defined in claim 20 and wherein:

said substrate layer has a porosity of between approximately 20% and 85%.

26. The invention as defined in claim 20 and wherein said substrate layer comprises a continuous web of backing material, and said heat-expandable non-combustible layer comprises a continuous mass of material.

27. The invention as defined in claim 21 and wherein:

said blanket-type material having a thickness when folded of between approximately 20 to 50% greater than the width of the joint.

28. The invention as defined in claim 27 and wherein:

the construction and arrangement is such that in the folded condition in the joint, the blanket-type material has a density of approximately 4 pounds per cubic foot and a retaining force of at least 0.05 pounds per square inch of surface contact.

* * * * *